US007769322B2

(12) United States Patent
Ishihara et al.

(10) Patent No.: US 7,769,322 B2
(45) Date of Patent: Aug. 3, 2010

(54) IMAGE READING APPARATUS

(75) Inventors: Masaaki Ishihara, Kawasaki (JP); Haruo Ishizuka, Ichikawa (JP); Tadashi Hanabusa, Kawasaki (JP); Katsumi Obana, Funabashi (JP); Shinya Asano, Meguro-ku (JP)

(73) Assignee: Canon Kabushiki Kaisha, Tokyo (JP)

( * ) Notice: Subject to any disclaimer, the term of this patent is extended or adjusted under 35 U.S.C. 154(b) by 516 days.

(21) Appl. No.: 11/676,451

(22) Filed: Feb. 19, 2007

(65) Prior Publication Data

US 2007/0196128 A1 Aug. 23, 2007

(30) Foreign Application Priority Data

Feb. 20, 2006 (JP) ..... 2006-042229

(51) Int. Cl.
*G03G 15/00* (2006.01)

(52) U.S. Cl. ..... 399/125; 399/380

(58) Field of Classification Search ..... 399/125, 399/380

See application file for complete search history.

(56) References Cited

U.S. PATENT DOCUMENTS

| | | | | |
|---|---|---|---|---|
| 5,541,712 | A * | 7/1996 | Fujitaka et al. | 399/380 |
| 5,905,926 | A * | 5/1999 | Taniguchi et al. | 399/125 |
| 2003/0056324 | A1 * | 3/2003 | Yazawa et al. | 16/289 |

FOREIGN PATENT DOCUMENTS

| | | |
|---|---|---|
| JP | 03-098060 | 4/1991 |
| JP | 07-244410 | 9/1995 |
| JP | 09-311389 | 12/1997 |

* cited by examiner

*Primary Examiner*—David P Porta
*Assistant Examiner*—Benjamin Schmitt
(74) *Attorney, Agent, or Firm*—Canon USA Inc IP Div

(57) ABSTRACT

An image reading apparatus includes an image reading unit, a compression spring unit, a braking unit, and a switching unit. The compression spring unit serves as an opening and closing mechanism for the image reading unit. The braking unit brakes the opening and closing movement of the image reading unit. The switching unit transmits the rotation of the image reading unit to the braking unit when the image reading unit closes, but does not transmit the rotation of the image reading unit to the braking unit when the image reading unit opens.

7 Claims, 16 Drawing Sheets

IMAGE READING APPARATUS

BACKGROUND OF THE INVENTION

1. Field of the Invention

The present invention relates to an image reading apparatus, such as a facsimile, a photocopier, or a multifunction device, that has an image reading unit that reads a document.

2. Description of the Related Art

A recording apparatus is configured to record an image on a recording medium with a recording head on the basis of image information. An image reading apparatus is configured to read an image of a document with a reading unit that includes an image sensor. Facsimiles, photocopiers, and multifunction devices can incorporate these apparatuses. Specifically, there are image reading and recording apparatuses that include an image reading unit that reads an image (including characters and signs) of a document, and a recording unit that records the image on a recording medium.

Japanese Utility Model Laid-Open No. 3-98060 discloses an image forming apparatus that has a configuration in which when a document table supported by a spring force is closed, the document table is locked by a lock mechanism. This lock mechanism is provided at a position such that when the document table is locked, the document is held horizontally. Japanese Patent Laid-Open No. 7-244410 discloses an image forming apparatus in which an opening and closing member is opened and closed using an opening and closing control mechanism that includes a tension spring and a hinge center damper. Japanese Patent Laid-Open No. 9-311389 discloses a document pressing plate opening and closing apparatus in which a document table is free stop in a particular range, and the document table falls from a certain position due to a spring force.

However, the above-described known arts have the following problems. In the case of Japanese Utility Model Laid-Open No. 3-98060, since the apparatus requires a lock mechanism when the document table is closed, the apparatus body is increased in size. In addition, when locked, the document table is continuously subjected to a force in the opening direction. Therefore, there is a possibility that creep deformation can deteriorate the accuracy and quality of components and that the reliability of the apparatus can deteriorate. In the case of Japanese Patent Laid-Open No. 7-244410, a user has to open the cover against the force of the damper, and therefore the operation takes a large force. Also in the case of Japanese Patent Laid-Open No. 9-311389, a user has to open the document table against the weight of the document table and the force of the damper, and therefore the operation takes a large force.

SUMMARY OF THE INVENTION

The present invention is directed to a small inexpensive image reading apparatus in which when a user closes an image reading unit, the image reading unit is prevented from closing rapidly, and the force required to open and close the image reading unit is small.

In an aspect of the present invention, an image reading apparatus includes an apparatus body, an image reading unit, a compression spring unit, a braking unit, and a switching unit. The image reading unit rotatably moves in opening and closing directions relative to the apparatus body. The compression spring unit urges the image reading unit in the opening direction when an angle defined by the image reading unit and the apparatus body is larger than a predetermined angle, and urges the image reading unit in the closing direction when the angle defined by the image reading unit and the apparatus body is smaller than the predetermined angle. The braking unit is configured to brake the rotating movement of the image reading unit. The switching unit transmits the rotating movement of the image reading unit to the braking unit when the image reading unit closes, but does not transmit the rotating movement of the image reading unit to the braking unit when the image reading unit opens.

Further features of the present invention will become apparent from the following description of exemplary embodiments (with reference to the attached drawings).

BRIEF DESCRIPTION OF THE DRAWINGS

In FIG. 18, the opening and closing torque of the image reading unit is not transmitted.

In FIG. 19, the opening and closing torque of the image reading unit is transmitted.

DESCRIPTION OF THE EMBODIMENTS

Figure 1:
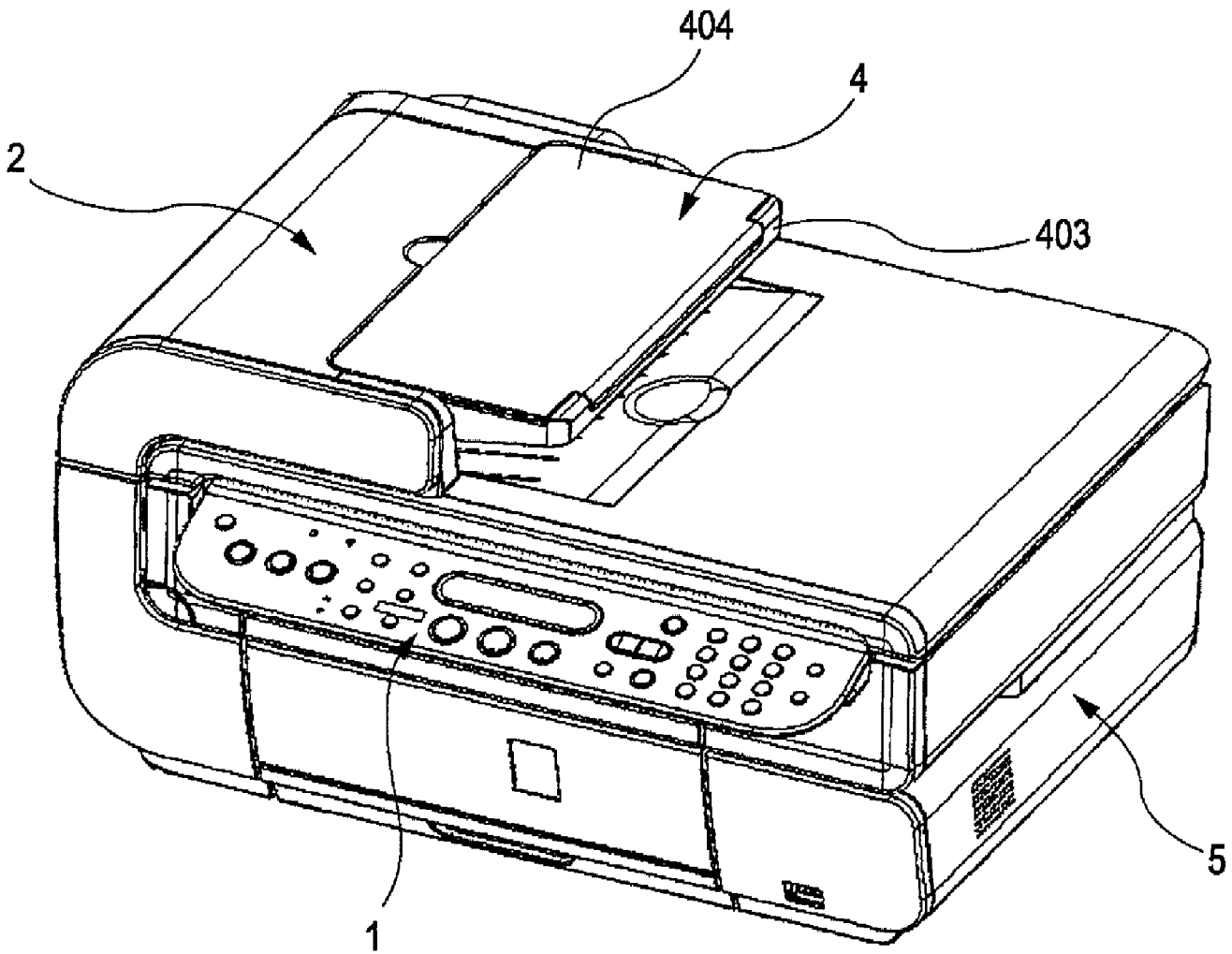
FIG. 1 is a perspective view of an image reading apparatus according to an embodiment.
Figure 2:
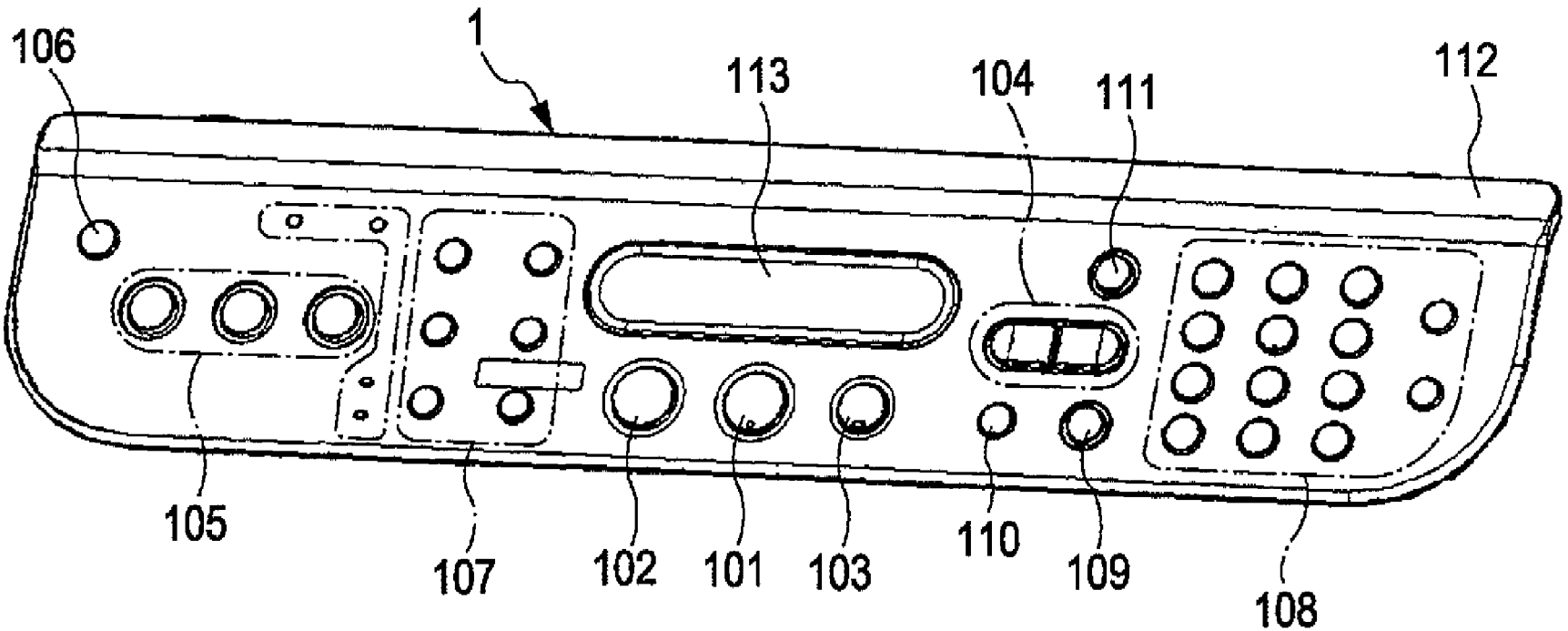
FIG. 2 is a top perspective view of a panel portion provided in an image reading unit of the image reading apparatus of FIG. 1.
Figure 3:
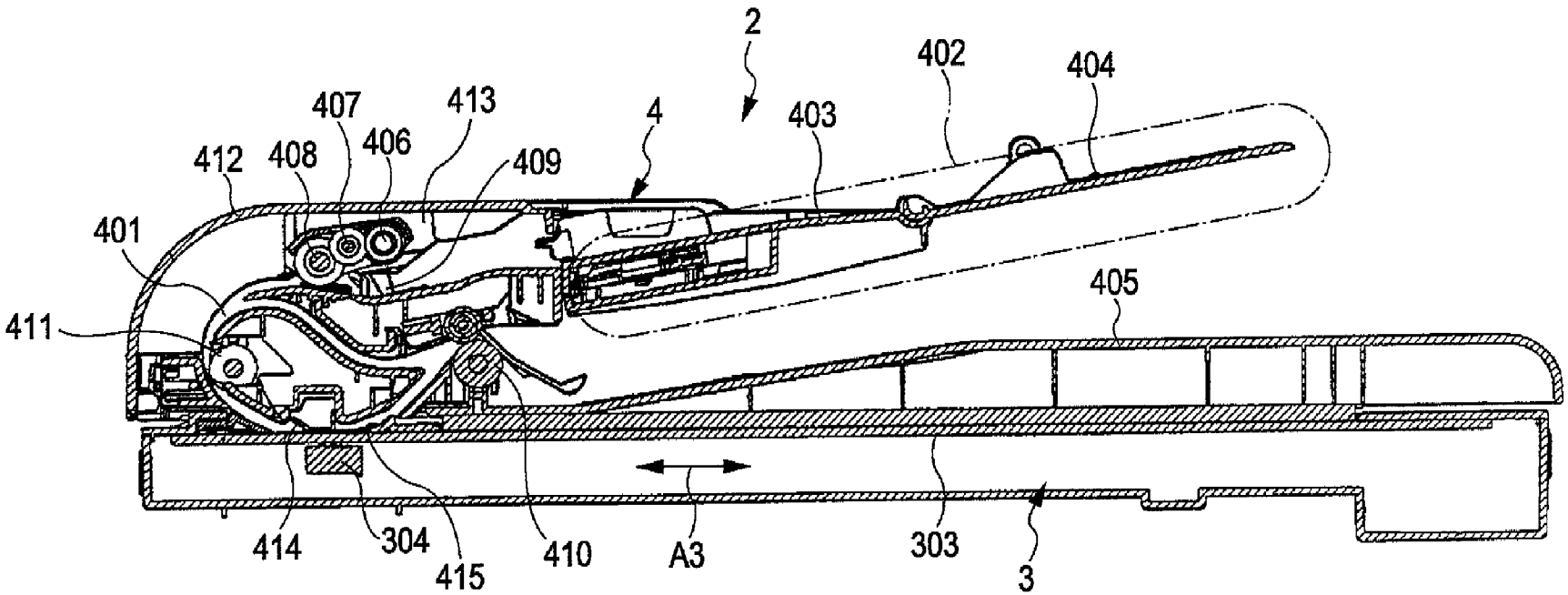
FIG. 3 is a vertical sectional view of the image reading unit.

The embodiments of the present invention will now be described with reference to the drawings. In all figures, the same reference numerals designate the same or corresponding components. FIG. 1 is a perspective view of an image reading apparatus according to an embodiment. FIG. 2 is a top perspective view of a panel portion provided in an image reading unit of the image reading apparatus of FIG. 1. FIG. 3 is a vertical sectional view of an ADF 4 and a scanner 3 of the image reading unit 2.

First, the panel portion (operation panel portion) 1 will be described. In FIG. 2, the panel portion 1 is provided with a color start key 101, a monochrome start key 102, a stop key 103, a selection key 104, and mode keys 105. In addition, the panel portion 1 is provided with a power key 106, function keys 107, dial keys 108, a decision key 109, a back key 110, and a menu key 111. These keys are attached to a panel cover 112. Under each key, a tactile switch (not shown) is soldered on a panel board (not shown). When each key is depressed, the tactile switch thereunder is turned on. In addition, a transparent display window member 113 is attached as a display portion. Through this display window member 113, an operator can view an LCD (not shown) attached to the panel board.

Next, the image reading unit 2 will be described. The image reading unit 2 includes the operation panel portion 1, the scanner 3, and the ADF 4. The image reading unit 2 is attached to a recording unit 5 in such a manner that the image reading unit can be opened and closed. The image reading unit 2 can rotate up to about 30 degrees with respect to the recording unit 5. The image reading unit 2 is opened, for example, when an ink cartridge in the recording unit 5 is replaced. The scanner 3 has a CIS (contact image sensor) 304 driven by a motor (not shown) in the direction of arrow A3 and for reading a document placed on a platen glass 303. The scanner 3 has a scanner case 302 and the platen glass 303. Inside the scanner 3 are disposed the CIS 304, a motor (not shown), a belt, and the like. The CIS 304 is movable in the horizontal direction under the platen glass 303. The motor drives the CIS 304. The belt transmits the driving force of the motor to the CIS 304.

The CIS 304 irradiates the image information surface of a document with light from a LED array. The light reflected on the image information surface is focused on a sensor element with a lens. The CIS 304 thus reads image information. When the CIS 304 reads a stationary document placed on the platen glass 303, the CIS 304 is moved by the driving force of the motor in the direction of arrow A3. When the CIS 304 reads documents conveyed from the ADF 4, the CIS 304 is fixed at the position shown in FIG. 3.

In FIG. 3, the ADF 4 is openably and closably (rotatably) attached to the top of the scanner 3. When a document placed on the platen glass 303 is read, the ADF 4 is closed. At this time, the ADF 4 functions as a pressing plate that presses the document against the platen glass 303. Inside the ADF 4 is provided a substantially U-shaped document conveyance path (hereinafter referred to as U-turn path) 401. A document supporting tray portion 402 is provided so as to be connected to the upstream end of the U-turn path 401. This tray portion 402 includes a tray base 403 and a tray 404. The tray 404 is openably and closably (rotatably) coupled to the tray base 403. A document discharge tray 405 is disposed so as to be connected to the downstream end of the U-turn path 401. This document discharge tray 405 constitutes the upper surface of the apparatus body.

In the upstream part of the U-turn path 401 is provided a pickup roller 406. The pickup roller 406 comes into contact with the uppermost one of the documents placed in the document supporting tray portion 402 and sends the document. The document sent by the pickup roller 406 is separated from the other documents by a separating portion. The separating portion includes a separating pad 407 and a separating roller 408 in contact therewith. Near the pickup roller 406 is provided a document presence sensor 409 that detects the presence or absence of the document. The above-described components constitute a document feeding device that feeds documents. At the downstream end of the U-turn path 401 are provided a document discharge roller pair 410 and a document edge sensor (not shown). The document discharge roller pair 410 discharges the document onto the document discharge tray 405. The document edge sensor detects the leading edge and the trailing edge of the document.

In FIG. 3, reference numeral 411 denotes a conveyance roller provided in the U-turn path 401 for conveying the document. Reference numeral 412 denotes an openable upper cover provided in the apparatus body. The upper cover 412 is opened, for example, in order to clear a document jam. Reference numeral 413 denotes a pickup arm. The pickup arm 413 is a holding member that is rotatably supported above the document supporting tray portion 402 and that rotatably holds the pickup roller 406. The pickup arm 413 holds the pickup roller 406 so that the pickup roller 406 can come into and go out of contact with the documents placed in the document supporting tray portion 402. When the documents are sent, the pickup arm 413 is rotated downward so that the pickup roller 406 can come into contact with the documents.

Documents can be placed into the ADF 4 face up. When documents are placed, the document presence sensor 409 detects the presence of the documents. An operator instructs to start reading from the operation panel portion 1. First, a driving portion (not shown) rotates so as to rotate the pickup arm 413 downward. The pickup roller 406 comes into contact with the upper surface of the documents. The pickup roller 406 then rotates so as to send the uppermost one of the documents placed in the document supporting tray portion 402.

Next, the uppermost document is separated from the other documents by the separating roller 408 and the separating pad 407, and is then fed into the U-turn path 401. The document fed into the U-turn path 401 is then conveyed by the conveyance roller 411 along the U-turn path 401 toward the reading position. After the document edge sensor (not shown) detects the leading edge of the document, the document is conveyed a predetermined distance, and then the CIS 304 starts reading the image information. At this time, the document is pressed by the reading white plate 414. After the start of reading, the document is scraped by a transparent scraper sheet 415 and is then guided to the document discharge roller pair 410.

After the document edge sensor (not shown) detects the trailing edge of the document, the document is conveyed a predetermined distance, and then the CIS 304 stops reading. After being read, the document is conveyed by the document discharge roller pair 410 toward the document discharge tray 405 and is discharged onto the document discharge tray 405. The image reading apparatus repeats the above-described reading operation until the document presence sensor 409 detects the absence of the document. The ADF 4 and the scanner 3 supporting the ADF 4 include many heavy components such as a plurality of motors, the platen glass 303, and other large frame components. Therefore, a large force is required to open and close the image reading unit 2.

Figure 4:
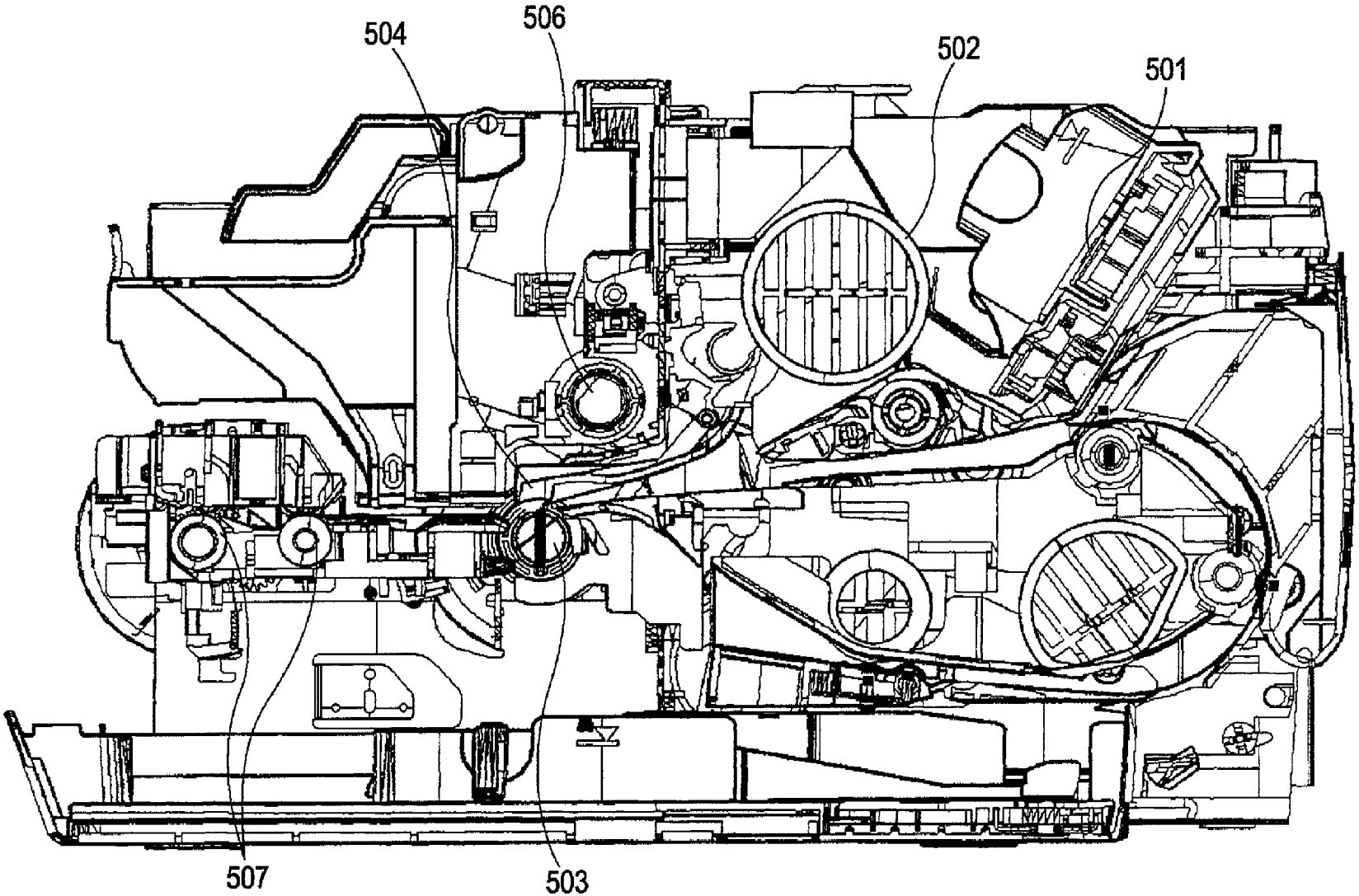
FIG. 4 is a vertical sectional view of the recording unit.

FIG. 4 is a vertical sectional view of the recording unit 5. Next, the recording unit 5 will be described. Upon receiving a record instruction, a cam (not shown) presses up a middle plate 501. The uppermost one of recording media stacked on the middle plate 501 is separated from the others by the rotation of a paper feeding roller 502 and the middle plate 501. The fed recording sheet is nipped by a nip portion between a conveyance roller 503 and a pinch roller 504, and is then conveyed by the rotation of the conveyance roller 503 at a constant speed to the image forming section.

The image forming section is provided with a recording head. The recording head is guided along and supported by a guide shaft 506 so as to be able to reciprocate in the direction perpendicular to the conveyance direction of the recording sheet. The recording head records an image on the recording sheet on the basis of image information. By alternately repeating the recording for one line and the sheet feed at a predetermined pitch, image recording is performed on the entire recording medium. After recording, the recording medium is discharged by a paper discharge roller pair 507 onto a paper discharge tray (not shown). The paper discharge tray opens automatically at the start of a recording operation. Therefore, even if the user forgets to open the paper discharge tray, paper jam is prevented.

Next, an example of the operation of the image reading apparatus according to the embodiment will be described. The user operates the image reading apparatus with the keys of the panel portion 1. A copying operation will be taken as an example. The user powers on the apparatus with the power key 106, and then selects the copy function with the mode keys 105. The user selects the image quality and the recording medium with the function keys 107, and sets the number of copies with the selection key 104. Next, the user opens the ADF 4 of the image reading unit 2, and places a document to be copied on the platen glass 303. Next, the user loads recording sheets in a recording sheet tray. Next, the user depresses the color start key 101 or the monochrome start key 102.

When the user uses the ADF 4 for copying, the user opens the tray 404 and places documents into the document supporting tray portion 402. Next, the user depresses the color start key 101 or the monochrome start key 102. Although copying is taken as an example of the operation, when scanning is selected with the mode keys 105, scanning can be performed from a PC connected to the apparatus via USB.

Figure 5:
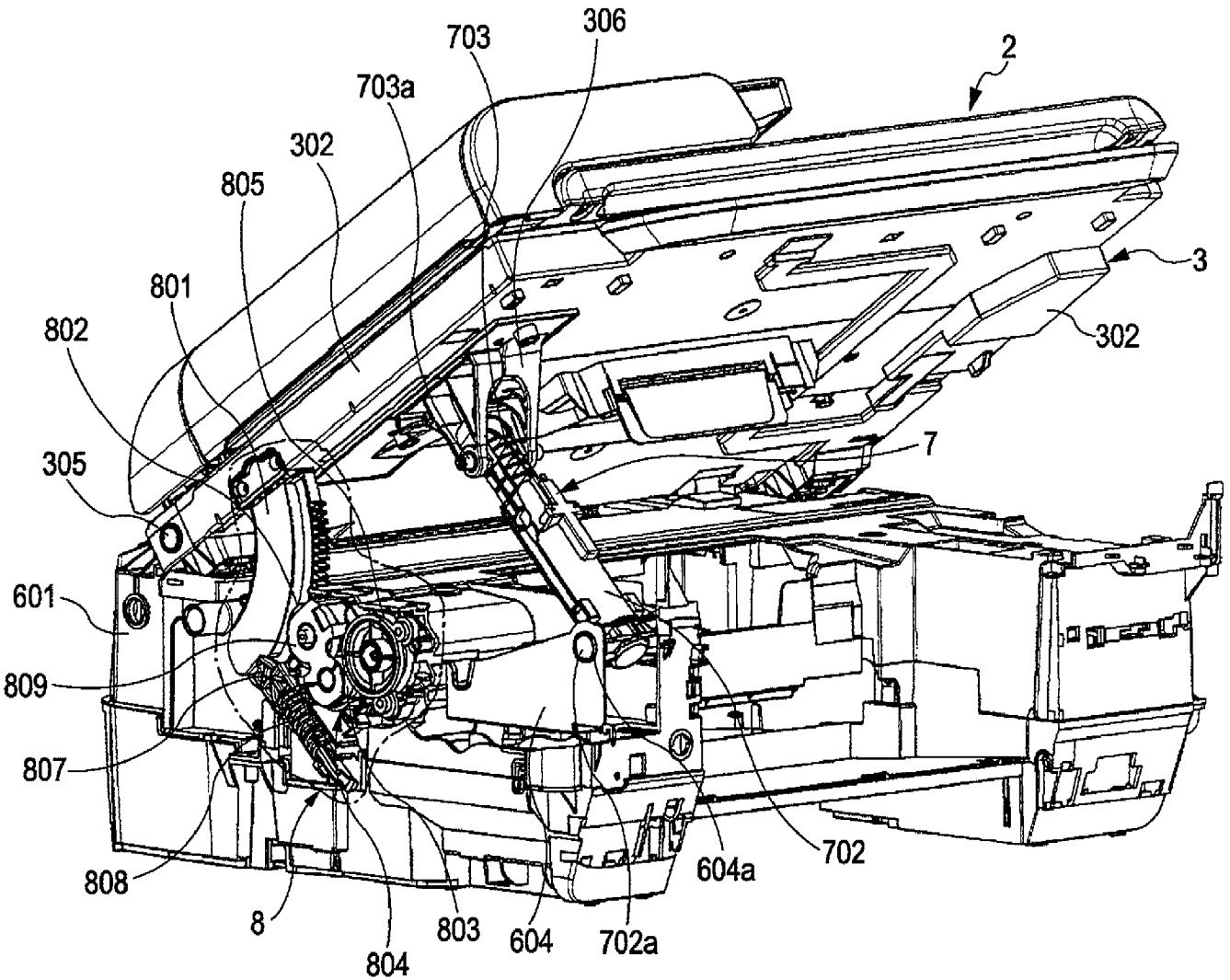
FIG. 5 is a perspective view showing the image reading apparatus with the image reading unit open.
Figure 6:
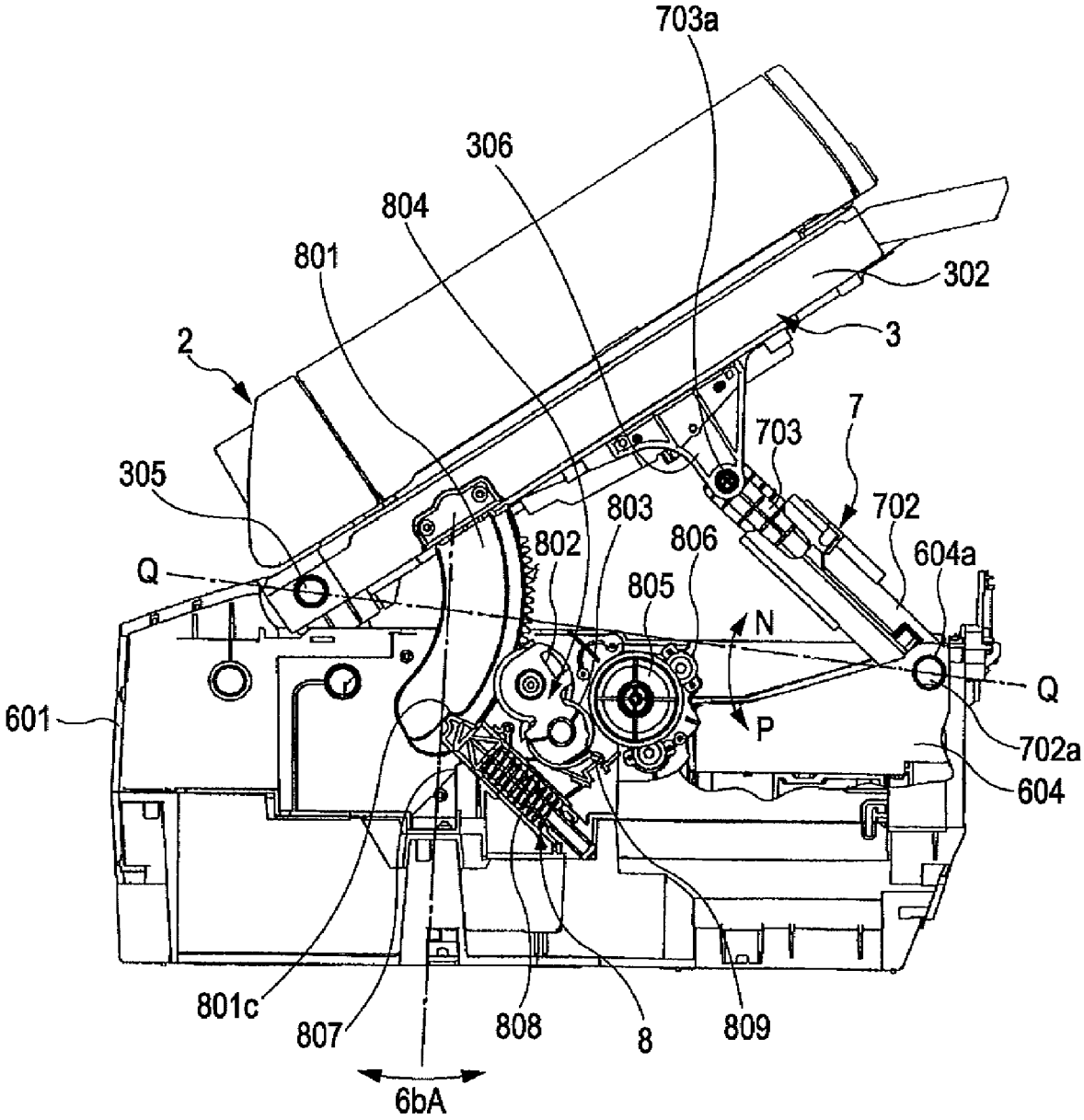
FIG. 6 is a side view showing the image reading apparatus with the image reading unit open.

FIG. 5 is a perspective view showing the image reading apparatus with the image reading unit 2 open. FIG. 6 is a side view showing the image reading apparatus with the image reading unit 2 open. In FIGS. 5 and 6, a compression spring unit 7 connects the scanner 3 of the image reading unit 2 and a middle frame 601 of the apparatus body. A hinge portion (not shown) of the case 302 of the scanner 3 is fitted in a bearing portion (not shown) of the middle frame 601 of the apparatus body. To the left side of the middle frame 601 is attached an antishock unit 8 that has a lock mechanism for holding the image reading unit 2 in the open position.

Figure 7:
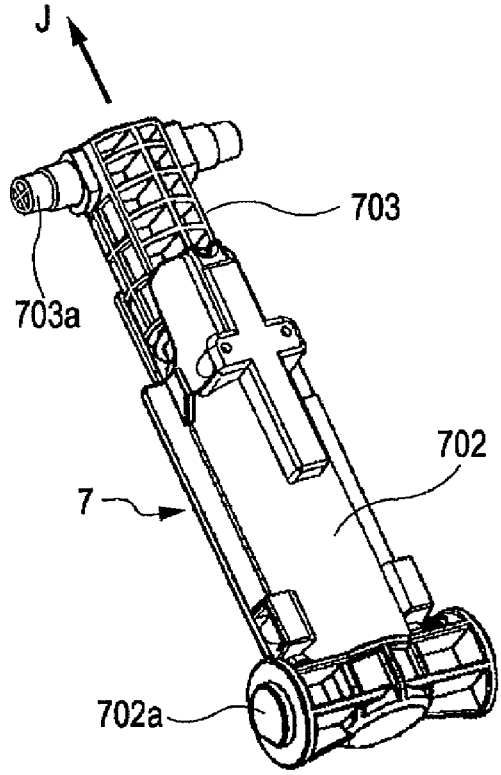
FIG. 7 is a perspective view showing an exterior of the compression spring unit.
Figure 8:
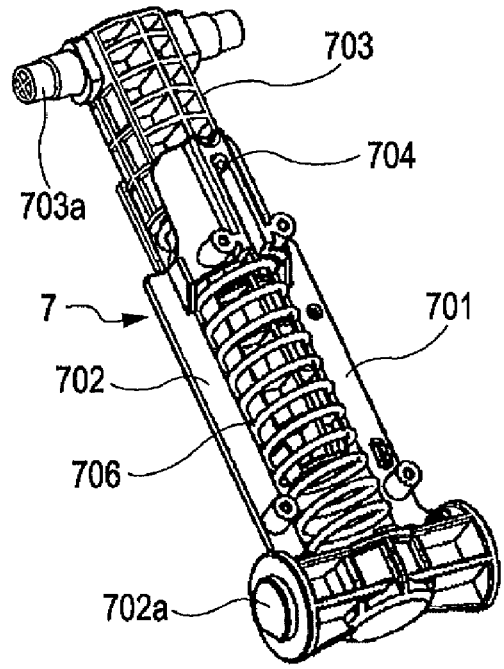
FIG. 8 is a perspective view showing the inner structure of the compression spring unit.
Figure 9:
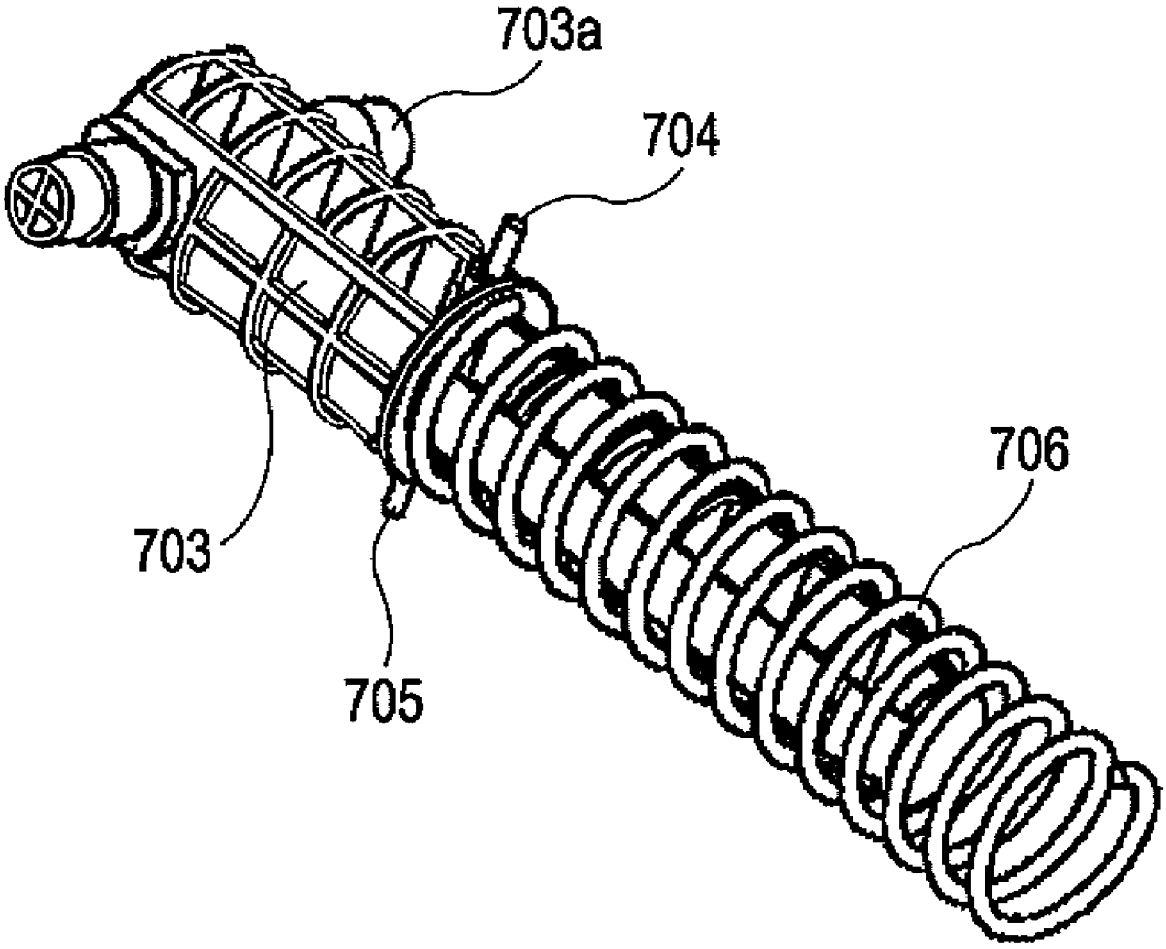
FIG. 9 is a perspective view showing a compression spring and a damper arm of the compression spring unit.

Next, the configuration of the compression spring unit 7 will be described with reference to FIGS. 7 to 9. FIG. 7 is a perspective view showing the exterior of the compression spring unit 7. FIG. 8 is a perspective view showing the inner structure of the compression spring unit 7. FIG. 9 is a perspective view showing a compression spring and a damper arm of the compression spring unit 7. The inner structure of the compression spring unit 7 includes a damper arm 703, spring pins 704 and 705, and a compression spring 706. The spring pins 704 and 705 are pressed into the damper arm 703.

In FIG. 7, a force in the direction of arrow J acts on the damper arm 703 so as to extend the compression spring unit 7. When the compression spring unit 7 has been extended a predetermined length, the spring pins 704 and 705 engage with a cover 701 so as to stop the movement of the damper arm 703. A pivot portion 703*a* of the damper arm 703 is rotatably coupled to a hinge 306 provided in the case 302 of the scanner 3. A pivot portion 702*a* of a damper base 702 is rotatably coupled to a bearing portion 604*a* of a base plate 604 provided in the middle frame 601 of the apparatus body. Due to this configuration, as shown in FIG. 6, when the compression spring unit 7 is above a line Q-Q connecting the bearing portion 604*a* of the base plate 604 and the rotation center of the scanner 3, a force in the direction of arrow N acts. When the compression spring unit 7 is below the line Q-Q, a force in the direction of arrow P acts. That is to say, the opening and closing mechanism of the image reading unit 2 is in a toggle relation with respect the line Q-Q. On the opening side, a force in the opening direction acts. On the closing side, a force in the closing direction acts.

Figure 10:
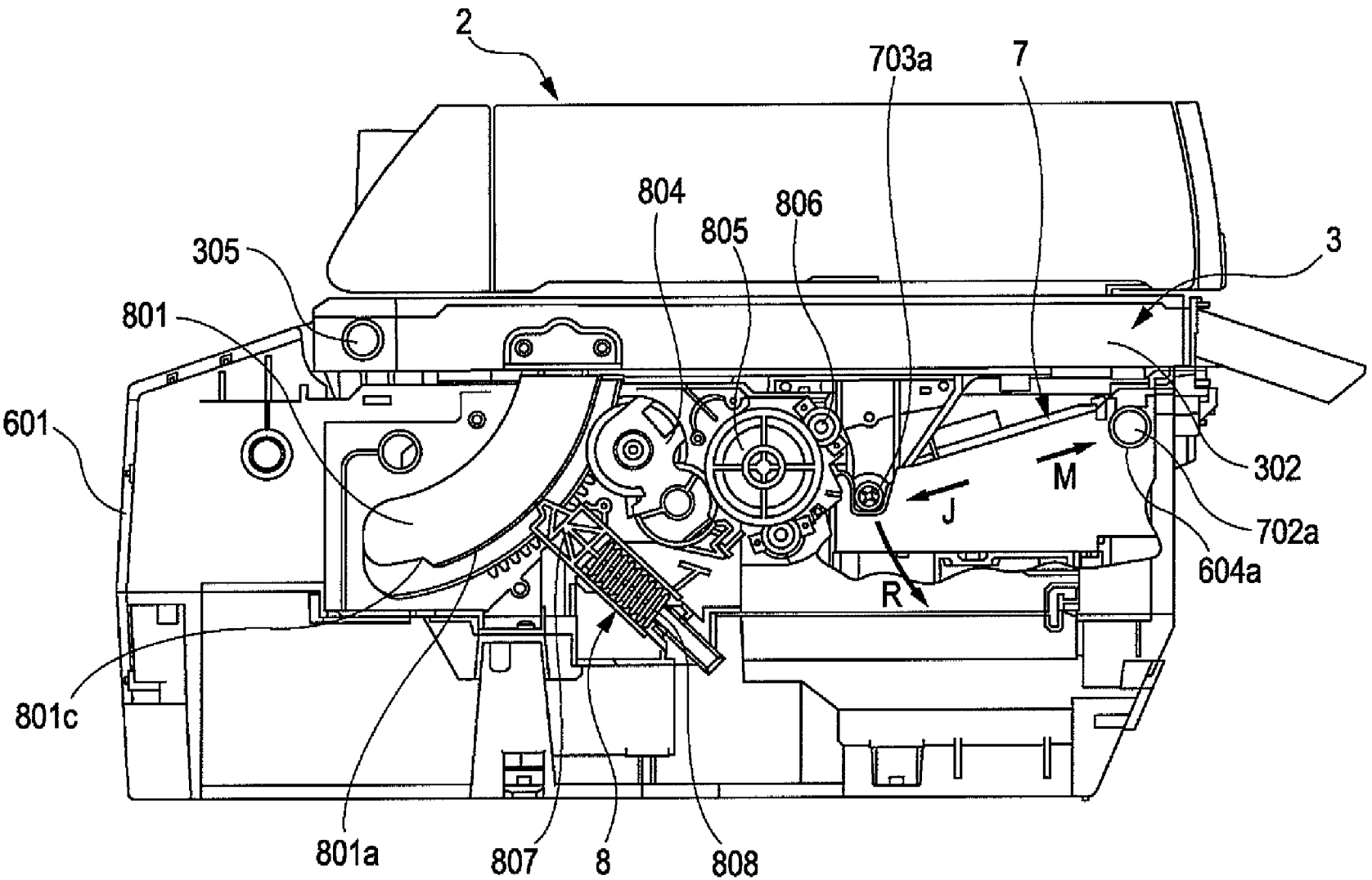
FIG. 10 is a side view showing the image reading apparatus with the image reading unit closed.

FIG. 10 is a side view showing the image reading apparatus with the image reading unit 2 closed. In FIG. 10, although the compression spring unit 7 tries to extend in the direction of arrow J, due to the above toggle relation, a force in the direction of arrow R acts on the compression spring unit 7. The pivot portion 702*a* of the damper base 702 is subjected to a force in the direction of arrow M. The pivot portion 703*a* of the damper arm 703, which is one pivot portion of the compression spring unit 7, is supported by the metal hinge 306, which is formed of metal. The pivot portion 702*a* of the damper base 702, which is the other pivot portion of the compression spring unit 7, is supported by the bearing portion 604*a* of the base plate 604, which is formed of metal.

Figure 11:
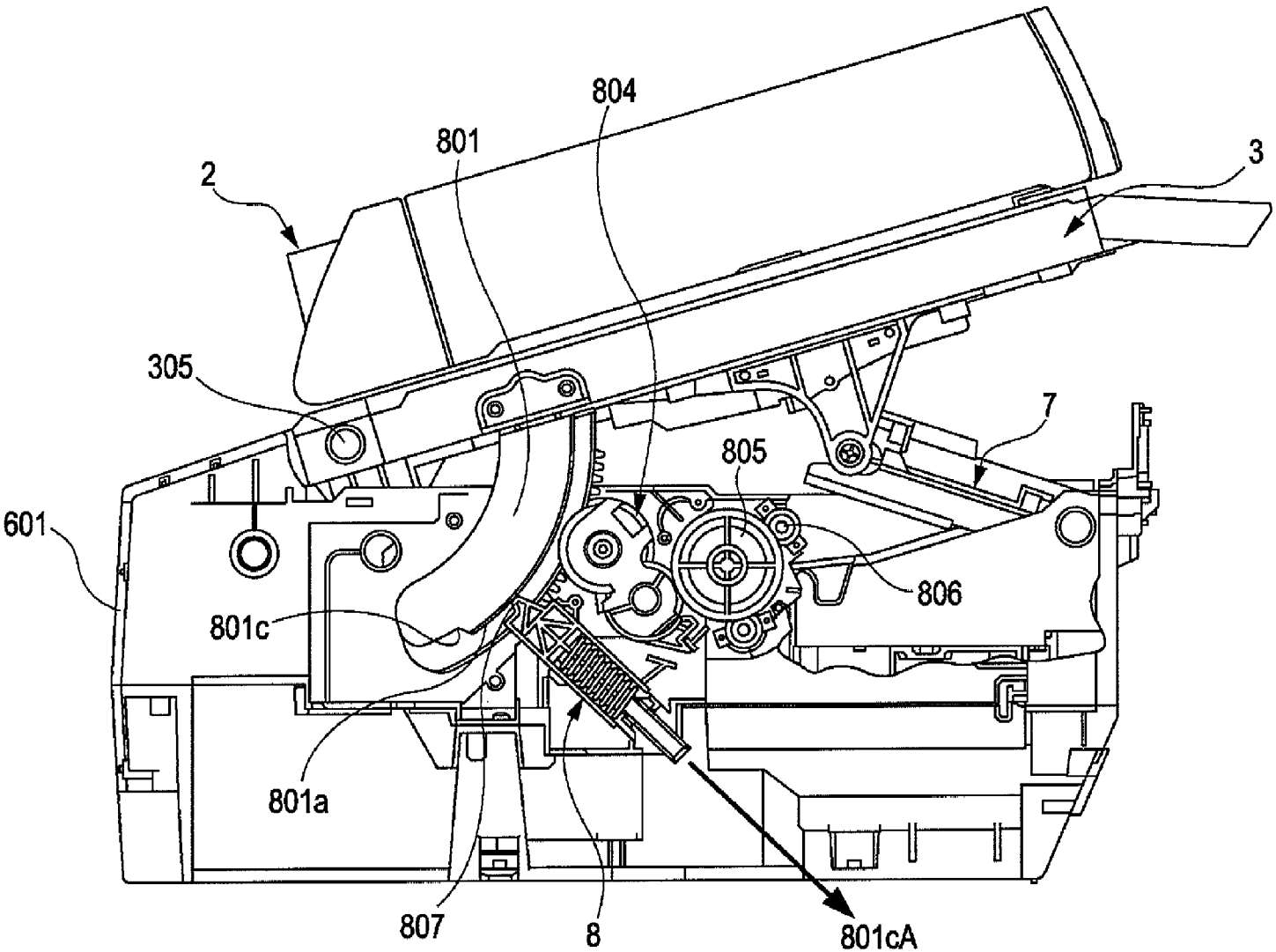
FIG. 11 is a side view showing the image reading apparatus with the image reading unit partly open.
Figure 12:
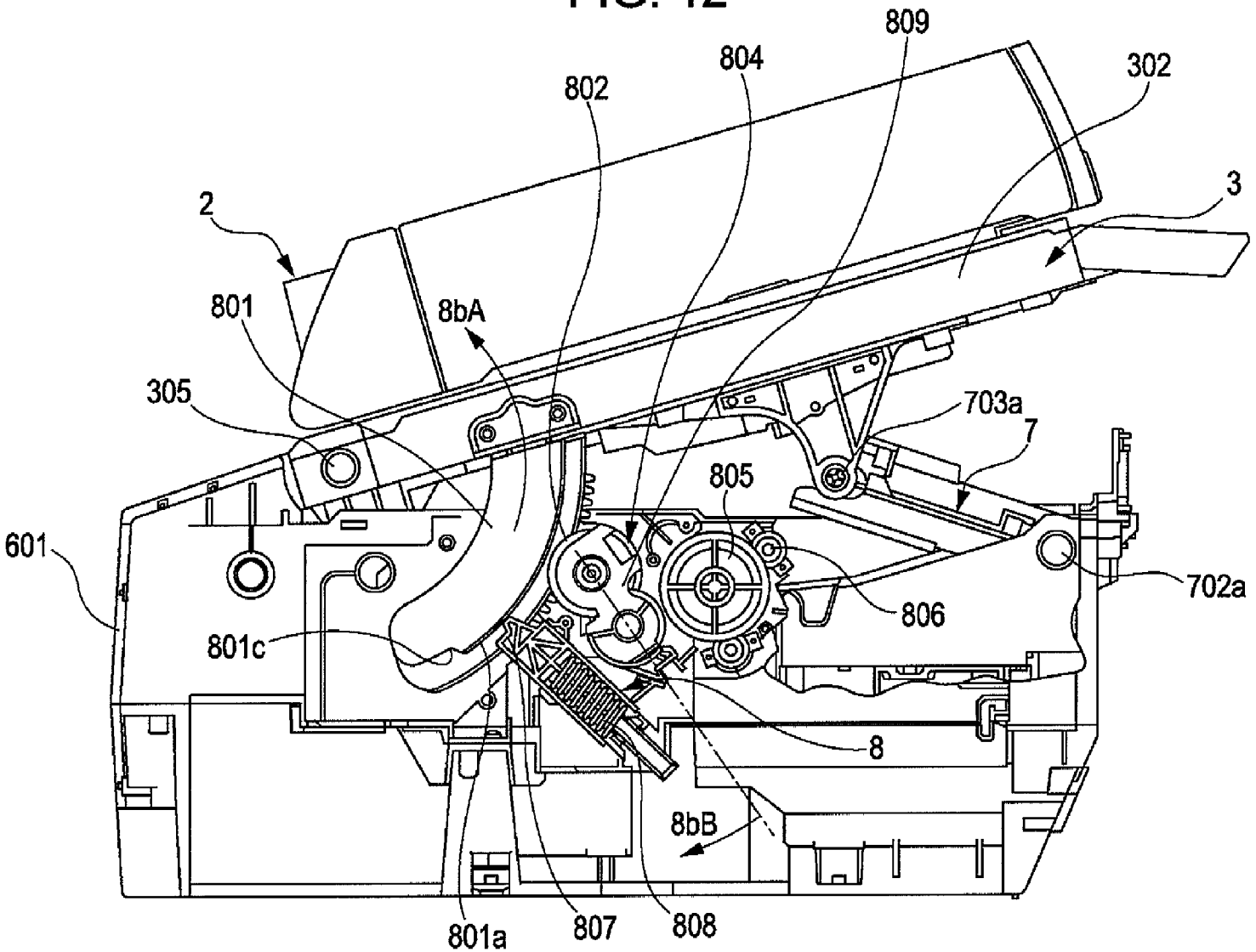
FIG. 12 is a side view showing the image reading apparatus with the image reading unit further open.
Figure 13:
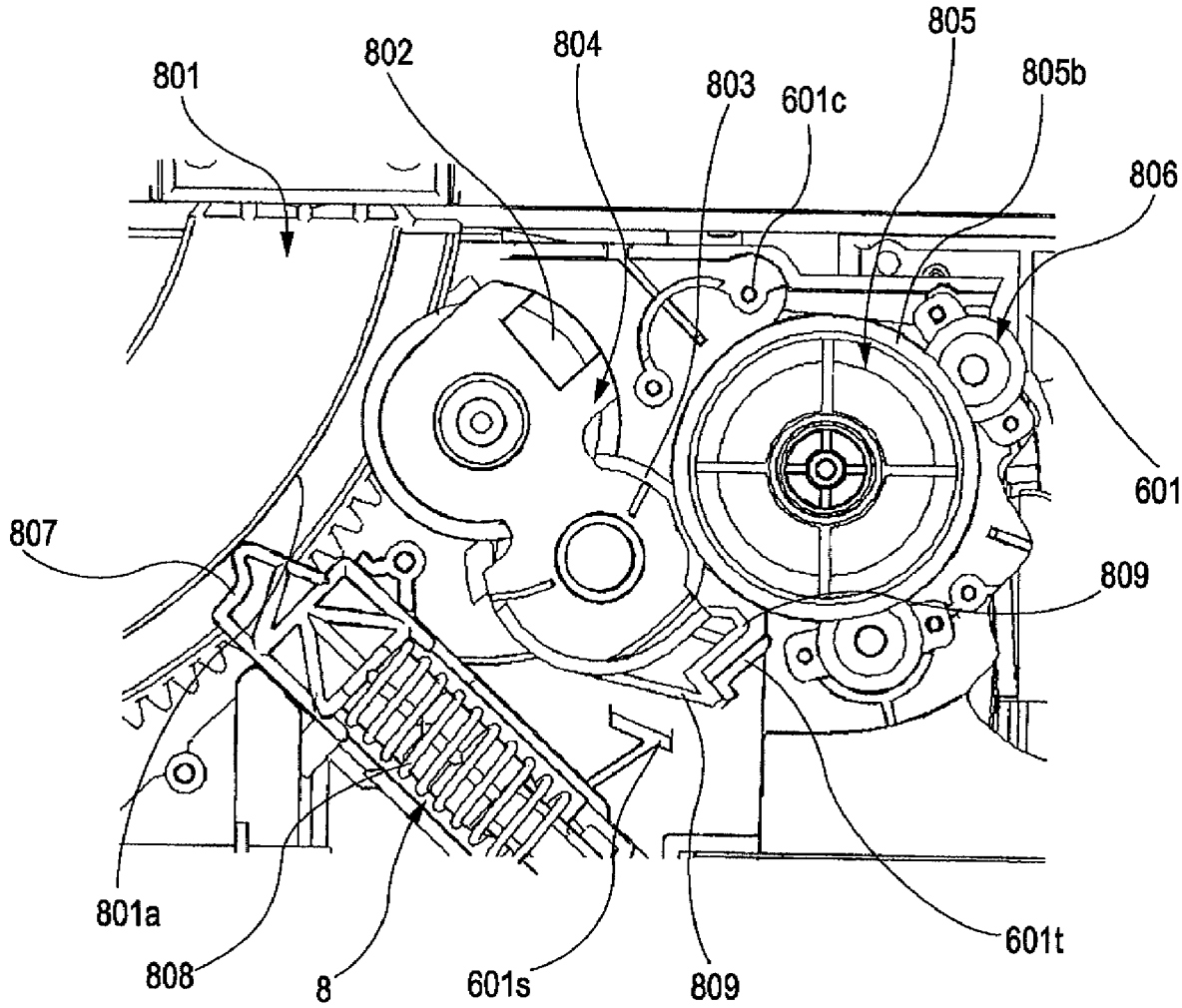
FIG. 13 is a partial side view showing an antishock unit when the image reading unit is closed.
Figure 14:
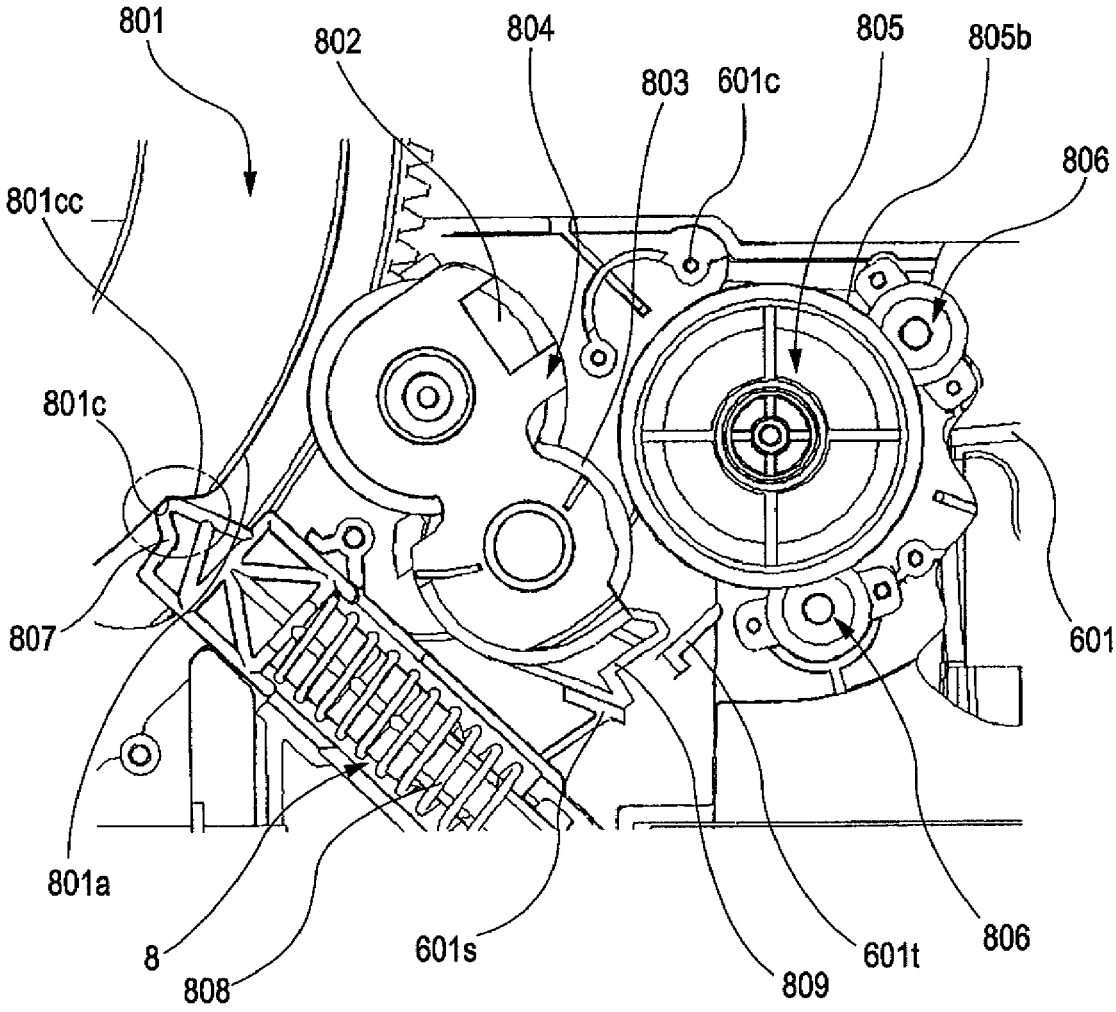
FIG. 14 is a partial side view showing the antishock unit when the image reading unit is in the open position.

FIG. 11 is a side view showing the image reading apparatus with the image reading unit 2 partly open. FIG. 12 is a side view showing the image reading apparatus with the image reading unit 2 further open. In FIG. 12, double gears are disengaged and the transmission of torque is cut off. That is to say, in FIG. 12, a swing arm unit 804 has rotated clockwise and the transmission of torque of a double gear in the swing arm unit 804 is cut off. FIG. 13 is a partial side view showing the antishock unit 8 when the image reading unit 2 is closed. FIG. 14 is a partial side view showing the antishock unit 8 when the image reading unit 2 is in the open position.

The antishock unit 8 includes a rack gear 801, the swing arm unit 804, torque limiters 806, a lock pin 807, and a lock pin spring 808. The swing arm unit 804 includes a swing arm 809 and double gears 802 and 803 attached to the swing arm 809. The torque limiters 806 are a combination of a rotating gear and an oil damper. The double gears 802 and 803 in the swing arm unit 804 engage with each other.

When the image reading unit 2 is closed as shown in FIG. 10, the lock pin 807 is pressed by the lock pin spring 808 against a sliding portion 801*a* of the rack gear 801. In FIG. 10, the swing arm unit 804 is in the transmitting state in which the swing arm unit 804 transmits the opening and closing force of the image reading unit 2. However, when the image reading unit 2 is closed, the swing arm unit 804 may be in the non-transmitting state in which the swing arm unit 804 does not transmit the opening and closing force. When an operator opens the image reading unit 2, for example, in order to replace an ink cartridge, the rack gear 801 rotates together with the image reading unit 2 counterclockwise in the direction of arrow 8*b*A in FIG. 12. This torque is transmitted to the double gear 802. However, due to a friction spring (not shown), a certain amount of frictional force acts between the double gear 802 and the swing arm 809. Therefore, the swing arm unit 804 rotates clockwise in the direction of arrow 8*b*B in FIG. 12. As shown in FIG. 14, the double gear 803 disengages from a double gear 805, and the transmission of torque is cut off. The swing arm unit 804 serves as a switching unit that transmits the rotation of the image reading unit 2 to the double gear 805 when the image reading unit 2 closes and that does not transmits the rotation of the image reading unit 2 to the double gear 805 when the image reading unit 2 opens.

The rack gear 801 is a transmission mechanism for transmitting the opening and closing movement of the image reading unit 2 to the double gear 805. With the counterclockwise rotation of the rack gear 801, the swing arm unit 804 rotates clockwise. The middle frame 601 of the apparatus body is provided with a stopper portion 601*s*. Therefore, due to the clockwise rotation of the swing arm unit 804, as shown in FIG. 14, the swing arm 809 comes into contact with the stopper portion 601*s*. Therefore, the swing arm unit 804 does not rotate any further. The double gear 802 rotates, sliding on the swing arm 809. The double gear 803 is rotated by the double gear 802. During this time, as shown in FIG. 11, the lock pin 807 pressed by the lock pin spring 808 against the rack gear 801 slides on the sliding portion 801*a* of the rack gear 801.

Figure 15:
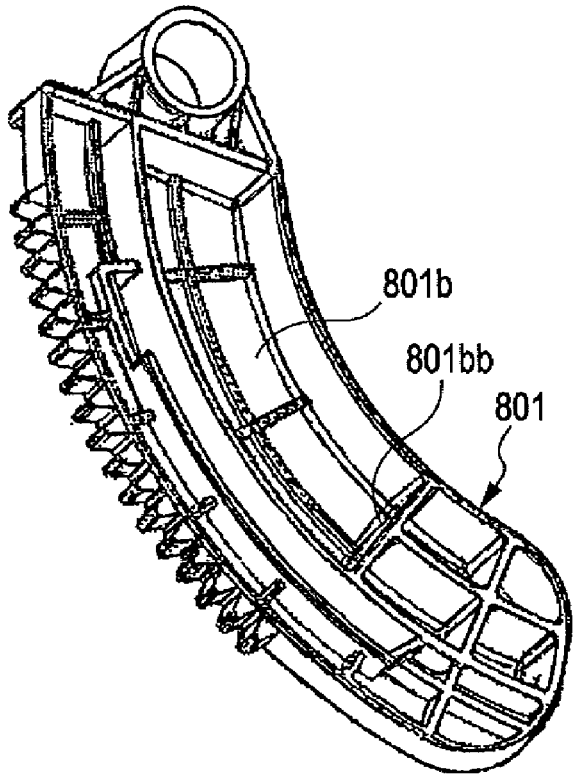
FIG. 15 is a perspective view of a rack gear.
Figure 16:
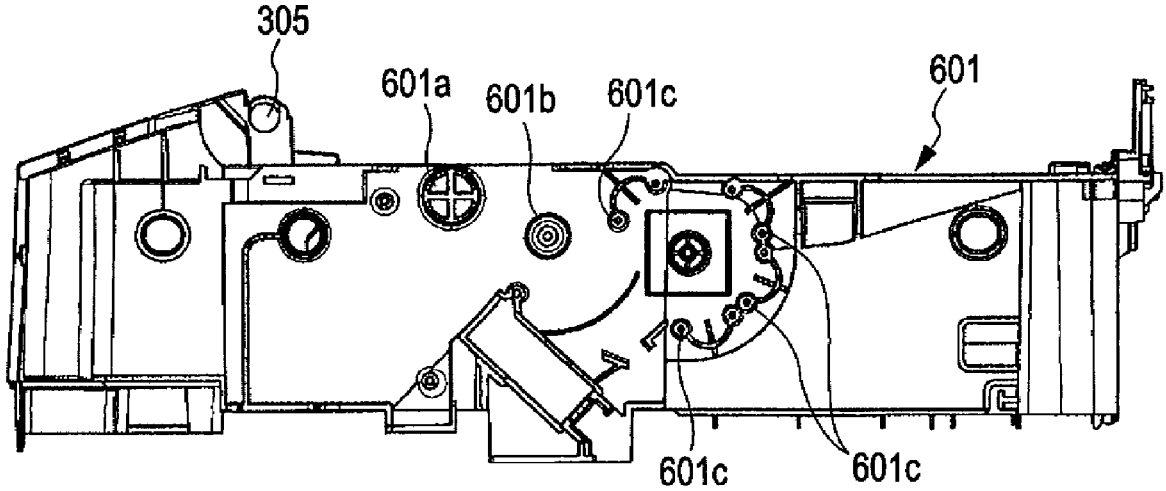
FIG. 16 is a side view of a middle frame of the apparatus body according to the embodiment.

FIG. 15 is a perspective view of the rack gear according to the embodiment. FIG. 16 is a side view of the middle frame of the apparatus body according to the embodiment. The rack gear 801 is provided with a groove 801*b*. When the image reading unit 2 is rotated to the open position as shown in FIG. 6, an end 801*bb* of the groove 801*b* comes into contact with a boss 601*a* provided in the middle frame 601. Therefore, the image reading unit 2 cannot open any further. In addition, as shown in FIGS. 6 and 14, the lock pin 807 is fitted in the depression 801*c* provided in the rack gear 801. This generates a holding force holding the scanner 3 in the open position via the rack gear 801 if the operator releases his hand from the image reading unit 2. By the resultant of this holding force and the spring force of the compression spring unit 7, the image reading unit 2 is held in the open position.

The rack gear 801 is attached to the case 302 of the scanner 3 so as to be able to rotate several degrees in the direction of double-ended arrow 6*b*A in FIG. 6. The boss 601*a* of the middle frame 601 is loosely fitted into the groove 801*b* of the rack gear 801, thereby restricting the position of the rack gear 801. Therefore, the center distance between the gear portion of the rack gear 801 and the double gear 802 is determined by the boss 601*a* that is provided in the middle frame 601 and a boss 601*b* that is provided in the middle frame 601 and that positions the double gear 802. If such a configuration is adopted, it is not necessary to position the gears via many components, and the dimensional accuracy required for each component is not very high. Therefore, the cost can be reduced. If there is no possibility that problems due to the deterioration in center distance accuracy, such as tooth skip and bottoming, and other problems in the gear portion occur, the rack gear 801 may be fixed to the scanner case 302.

Next, the closing operation of the image reading unit 2 will be described. A force in the closing direction is exerted on the image reading unit 2 held in the open position. The lock pin 807, which is pressed by the lock pin spring 808 and is fitted in the depression 801*c* of the rack gear 801, is pressed by the cam shape 801*cc* of the depression 801*c* shown in FIG. 14. Therefore, the lock pin 807 moves in the direction of arrow 801*c*A in FIG. 11 against the pressing force of the spring 808. When the lock pin 807 is engaged from the depression 801*c*, the compression spring unit 7 is the only device holding the image reading unit 2. It is not likely for the compression spring unit 7 alone to hold the image reading unit 2. Therefore, the compression spring unit 7 is contracted by the weight of the image reading unit 2, and the image reading unit 2 rotates in the closing direction.

With the rotation of the image reading unit 2 in the closing direction, the rack gear 801 rotates clockwise. The double gear 802 thereby rotates counterclockwise. At this time, since a frictional force acts between the double gear 802 and the swing arm 809 due to the friction spring (not shown), the swing arm unit 804 rotates counterclockwise. As shown in FIG. 13, after the swing arm 809 has come into contact with a stopper 601*t* of the middle frame 601, the swing arm unit 804 does not rotate any further. The double gear 802 rotates, sliding on the swing arm 809. At this time, the double gear 803 engages with the double gear 805. By this engagement, the rotation of the image reading unit 2 in the closing direction is transmitted via the rack gear 801 and the double gears 802, 803, and 805 to the torque limiters 806, which serve as braking units. The double gear 805 is an intermediate transmission unit for transmitting the torque of the swing arm unit 804 to the torque limiters 806.

As described above, the swing arm 809 of the swing arm unit 804 and the double gears 802 and 803 constitute a switching mechanism that transmits the rotation of the image reading unit 2 to the torque limiters 806 when the image reading unit 2 rotates in the closing direction. On the other hand, this switching mechanism does not transmit the rotation of the image reading unit 2 to the torque limiters 806 when the image reading unit 2 rotates in the opening direction. The torque limiters 806 generate a force in the opposite direction from the rotation according to the rotation speed. Therefore, a braking force acts on the image reading unit 2 via the double gears 805, 803, and 802 and the rack gear 801. Thus, the rotation speed of the image reading unit 2 in the closing direction can be reduced. In the double gear 805, the pitch diameter of the gear 805*b*, which engages with the torque limiters 806, is set large. Therefore, the gear 805*b* can be engaged with a plurality of torque limiters 806. In the embodiment, the middle frame 601 of the apparatus body is provided with four torque limiter mounts 601*c*, and the torque limiters 806 are attached to only two of them.

As described above, the embodiment relates to an image reading apparatus in which an image reading unit 2 is openably and closably (rotatably) attached to the apparatus body. The image reading apparatus according to the embodiment includes a compression spring unit 7 that urges the image reading unit 2 in the opening direction when the rotation angle of the image reading unit 2 is larger than a predetermined angle and that urges the image reading unit 2 in the closing direction when the rotation angle of the image reading unit 2 is smaller than the predetermined angle. The apparatus further includes a rack gear 801 for transmitting the opening and closing movement of the image reading unit 2 to torque limiters 806 that brakes the opening and closing movement. The apparatus further includes a switching mechanism that transmits the rotation of the image reading unit 2 to the torque limiters 806 when the image reading unit 2 rotates in the closing direction and that does not transmit the rotation of the image reading unit 2 to the torque limiters 806 when the image reading unit 2 rotates in the opening direction. This switching mechanism includes a swing arm 809 of a swing arm unit 804 and double gears 802 and 803.

In addition, the image reading apparatus according to the embodiment includes a lock mechanism that restricts the angle at which the image reading unit 2 opens and that holds the image reading unit 2 in the open position. Between the swing arm unit 804 and the torque limiters 806 is disposed a double gear 805. When the image reading unit 2 rotates in the opening direction, its rotation is transmitted to the swing arm unit 804 but is not transmitted to the torque limiters 806.

In the embodiment, the rack gear is attached to the image reading unit 2, and the swing arm unit, the torque limiters, and the antishock unit are attached to the apparatus body. However, the rack gear may be attached to the apparatus body, and the swing arm unit, the torque limiters, and the antishock unit may be attached to the image reading unit. Also in this case, the same advantages can be obtained.

Figure 17:
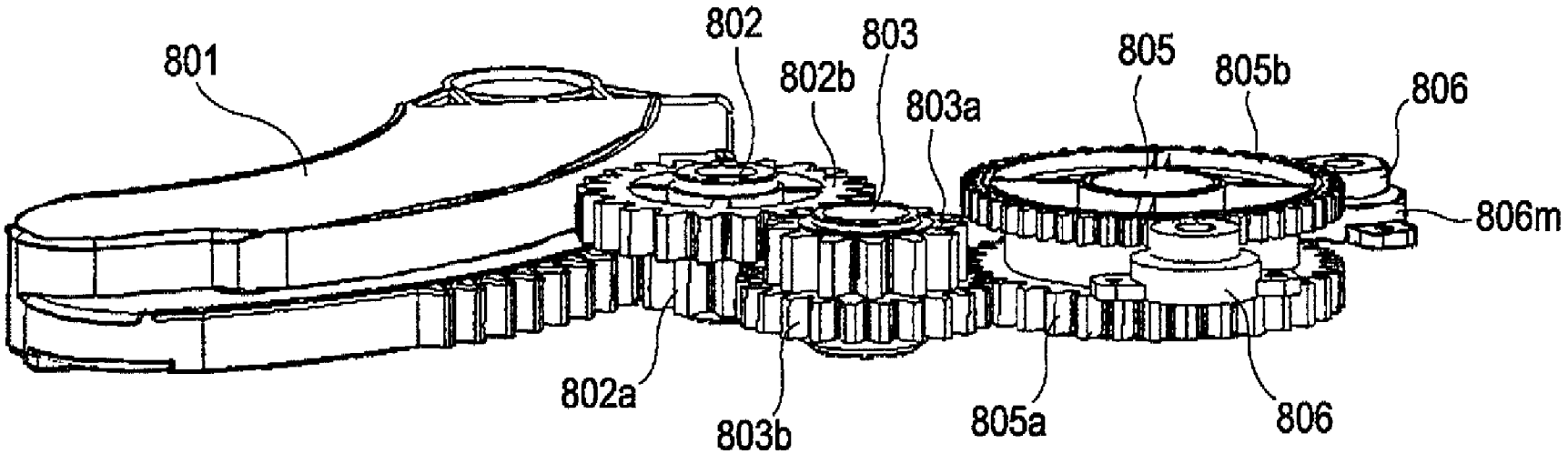
FIG. 17 is a perspective view showing the configuration of the antishock unit that reduces the speed at which the image reading unit opens and closes in the image reading apparatus according to the embodiment.

FIG. 17 is a perspective view showing the configuration of the antishock unit according to the embodiment.

The modules of the rack gear 801, the double gears 802, 803, and 805, and the gear portions of the torque limiters 806 can be set large in order to strengthen their teeth. However, the modules can be limited due to limitations of space. In the embodiment, the modules of the rack gear 801 and the gear 802*a* of the double gear 802 are set to 1.5, and the modules of the gear 802*b* of the double gear 802 and the gear 803*a* of the double gear 803 are also set to 1.5. However, the modules of the gear 803*b* of the double gear 803 and the gear 805*a* of the double gear 805 are set to 1.2 so that their pitch diameters are prevented from being too large. The module of the gear 805*b* of the double gear 805 is set to 0.8 so as to correspond to the module of generally used torque limiters.

In the embodiment, the gear 805*a* and the gear 805*b* have substantially the same pitch diameter but different modules. For example, if the swing arm 809 is attached loosely, the double gear 803 can move toward the gear 805*b*, and the gear 803*b* can be caught by the gear 805*b*. In order to prevent this, a gap is provided between the gear 805*a* and the gear 805*b*, and body portions 806*m* of the torque limiters 806 are disposed in this gap.

Figure 18:
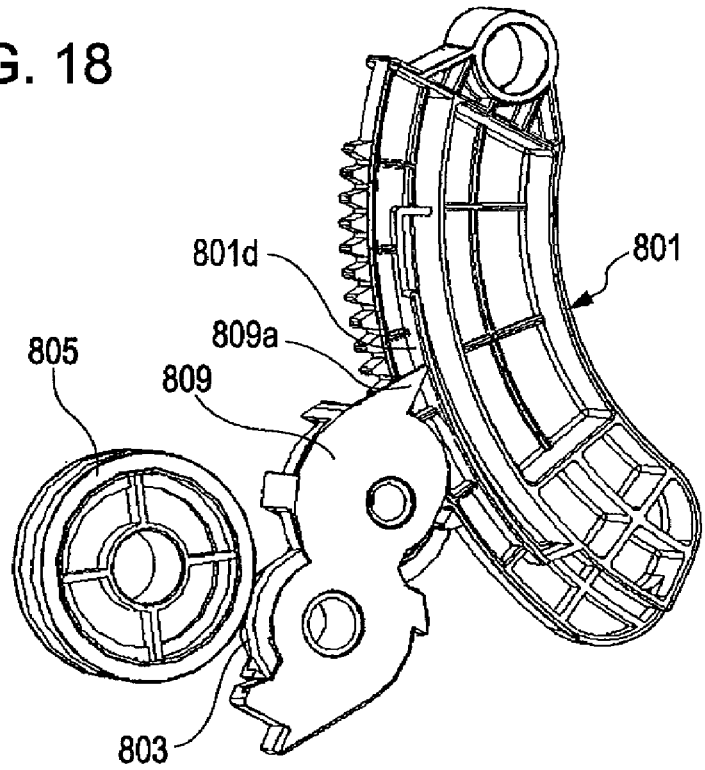
FIG. 18 is a perspective view showing another example of the antishock unit of the image reading apparatus in the embodiment.
Figure 19:
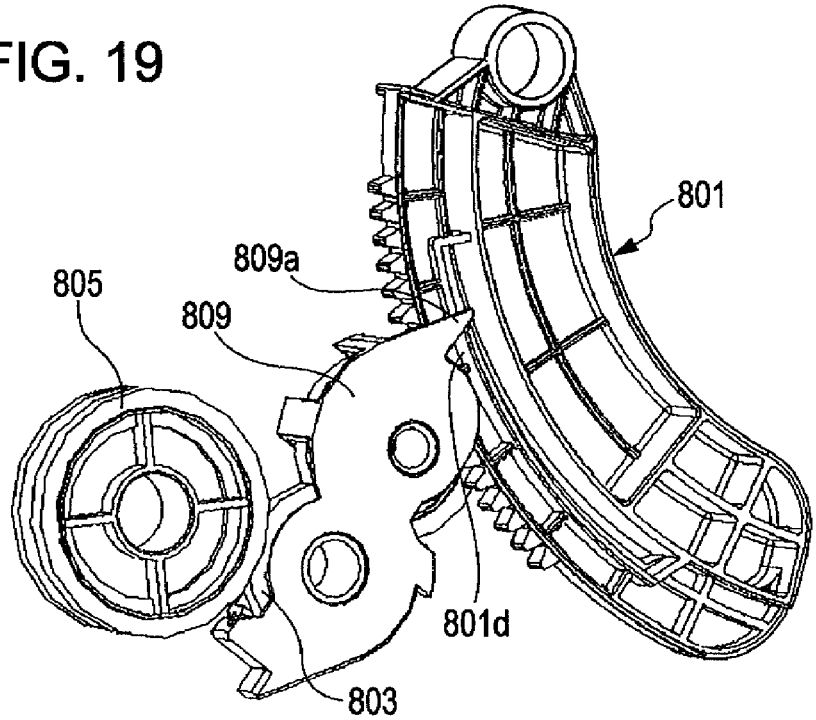
FIG. 19 is a perspective view showing the antishock unit of FIG. 18.

FIGS. 18 and 19 are perspective views showing a second example of the antishock unit 8 in the embodiment. In FIG. 18, the opening and closing torque of the image reading unit 2 is not transmitted. In FIG. 19, the opening and closing torque of the image reading unit 2 is transmitted. In the antishock unit 8 according to the second example, the rack gear 801 is provided with a cam shape 801*d*, and the swing arm 809 is provided with a cam shape 809*a*. These cam shapes 801*d* and 809*a* prevent the operation of the swing arm 809 until the image reading unit 2 is closed at a certain angle. Thus, the transmitting state and non-transmitting state of the swing arm 809 can be controlled according to the angle of the image reading unit 2.

The angle at which switching is performed between the transmitting state and non-transmitting state can be changed by changing the cam shape 801*d* of the rack gear 801. If this configuration is adopted, the angle at which the damper starts working can be variously set. Therefore, if the balance of the opening and closing mechanism changes depending on the weight of the image reading unit 2 and the strength of the spring of the compression spring unit 7, the optimum timing of buffering can be obtained by just changing the shapes of the cams 801*d* and 809*a*.

If the above-described embodiment is adopted, the image reading unit 2 can be closed without providing a lock mechanism, and the image reading unit 2 can be prevented from closing rapidly. In addition, the force required to open and close the image reading unit can be reduced without increasing the size and cost.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2006-042229 filed Feb. 20, 2006, which is hereby incorporated by reference herein in its entirety.

What is claimed is:

1. An image reading apparatus comprising:

an apparatus body;

an image reading unit rotatably moving in opening and closing directions relative to the apparatus body;

a compression spring unit urging the image reading unit in the opening direction when an angle defined by the image reading unit and the apparatus body is larger than a predetermined angle and urging the image reading unit in the closing direction when the angle defined by the image reading unit and the apparatus body is smaller than the predetermined angle;

a braking unit configured to brake the rotating movement of the image reading unit; and a switching unit transmitting the rotating movement of the image reading unit to the braking unit while closing the image reading unit but not transmitting the rotating movement of the image reading unit to the braking unit while opening the image reading unit.

2. The image reading apparatus according to claim 1, the switching unit comprising:

a rack gear disposed in the image reading unit and configured to move with the rotating movement; and a swing arm unit disposed in the apparatus body and having transmission gears, the rack gear engaging with one of the transmission gears, wherein the swing arm swings to transmit the rotating movement of the transmission gear to the braking unit when the switching unit transmits the rotating movement of the image reading unit, the swing movement of the swing arm is caused by the rotating movement of the image reading unit while closing, and the swing movement of the swing arm not transmitting the rotating movement of the transmission gear is caused by the rotating movement of the image reading unit while opening.

3. The image reading apparatus according to claim 1, further comprising a lock mechanism restricting the angle defined by the image reading unit and the apparatus body and holding the image reading unit in an open position.

4. The image reading apparatus according to claim 3, further comprising a rack gear disposed in the image reading unit, wherein when the image reading unit is in the open position, the lock mechanism engages with the rack gear so as to provide a holding force holding the image reading unit in the open position.

5. The image reading apparatus according to claim 4, wherein when a force in the closing direction is exerted on the image reading unit in the open position, the holding force is released.

6. The image reading apparatus according to claim 4, wherein when the image reading unit is in the open position, the image reading unit is held in the open position by the resultant of an urging force of the compression spring unit and the holding force of the lock mechanism.

7. The image reading apparatus according to claim 1, wherein the braking unit is a rotating gear type torque limiter.

* * * * *